US008681052B2

(12) United States Patent
Fuchs et al.

(10) Patent No.: US 8,681,052 B2
(45) Date of Patent: Mar. 25, 2014

(54) LOW PROFILE WIDEBAND ANTENNA

(75) Inventors: Andreas D. Fuchs, Lake Orion, MI (US); Elias H. Ghafari, Rochester Hills, MI (US)

(73) Assignee: Blaupunkt Antenna Systems USA, Inc., Rochester Hills, MI (US)

( * ) Notice: Subject to any disclaimer, the term of this patent is extended or adjusted under 35 U.S.C. 154(b) by 185 days.

(21) Appl. No.: 13/252,566

(22) Filed: Oct. 4, 2011

(65) Prior Publication Data

US 2013/0082879 A1 Apr. 4, 2013

(51) Int. Cl.
*H01Q 1/38* (2006.01)
*H01Q 9/04* (2006.01)

(52) U.S. Cl.
USPC ..... 343/700 MS; 343/725; 343/826; 343/737

(58) Field of Classification Search
USPC ..... 343/700
See application file for complete search history.

(56) References Cited

U.S. PATENT DOCUMENTS

| | | | | |
|---|---|---|---|---|
| 6,433,747 | B1 * | 8/2002 | Cumro et al. | 343/700 MS |
| 6,963,313 | B2 * | 11/2005 | Du | 343/790 |
| 2009/0256778 | A1 | 10/2009 | Du | |
| 2010/0085264 | A1 | 4/2010 | Du et al. | |
| 2011/0080323 | A1 * | 4/2011 | Thiam et al. | 343/700 MS |

* cited by examiner

*Primary Examiner* — Jerome Jackson, Jr.
*Assistant Examiner* — Andrea Lindgren Baltzell
(74) *Attorney, Agent, or Firm* — Warner Norcross & Judd LLP

(57) ABSTRACT

The specification discloses a low-profile, ultra wideband, inverted f antenna having increased bandwidth. The antenna includes a ground plane, a planar antenna element spaced from the ground plane, a first tubular element electrically connected to and extending from the ground plane toward the antenna element, and a second tubular element electrically connected to and extending from the antenna element toward the ground plane. The tubular elements physically interfit but are electrically separated. The antenna is compatible with LTE, GPS and satellite radio communications to provide a compact antenna suitable for use in automotive and other applications.

18 Claims, 17 Drawing Sheets

LOW PROFILE WIDEBAND ANTENNA

BACKGROUND OF THE INVENTION

The present invention relates to antennas, and more particularly to planar inverted-F antennas.

Antennas are widely utilized in automotive applications. In addition to the familiar AM/FM whip antenna, automobiles are increasingly equipped with antennas for GPS (Global Positioning System) and satellite radio. Typical frequencies for GPS antennas include 1.574 GHz to 1.576 GHz, while typical frequencies for satellite radio antennas include 2.320 GHz to 2.345 GHz. These antennas can be integrated into a single assembly contained within the vehicle or a housing typically mounted on the vehicle roof.

With the recent introduction of the Long Term Evolution (LTE) Advanced standard, antennas adapted for 4G communications must cover frequencies outside the frequency ranges for AM/FM, GPS and satellite radio. For example, LTE-compatible antennas must generally include a bandwidth covering a frequency range from 0.7 GHz to 2.7 GHz. In addition, shipping restrictions in the automobile industry limit the height of an antenna, including the housing, to 40 mm (millimeters) above the roof. Therefore, LTE-compatible automobile antennas must cover the frequency range for LTE communications—and in many instances existing GPS and satellite radio communications—while also maintaining a vertical profile of no more than 40 mm.

Existing antenna systems are incapable of meeting these requirements. For example, wideband monopole antennas are not capable of covering the desired frequency range. In addition, wideband monopole antennas do not currently meet a 40 mm height limitation.

Planar Inverted-F Antennas (PIFAs) are much lower in profile and meet the 40 mm height requirement. However, PIFAs do not meet bandwidth requirements for LTE communications. Current PIFAs have a bandwidth of approximately 10%, providing for example a frequency range of only 80 MHz for a center frequency of 800 MHz. In some instances the PIFA includes a dual resonating structure to improve the antenna's bandwidth. For example, a dual resonating structure can provide a second frequency centered at 1.9 GHz and covering the frequency range between 1.82 GHz and 1.98 GHz, marginally improving the total bandwidth to only about 240 MHz.

SUMMARY OF THE INVENTION

The present invention as disclosed and claimed is a low-profile PIFA antenna having significantly increased bandwidth over existing PIFAs. The antenna includes a ground plane, a top planar element supported above the ground plane, a feed, and a tubular element extending from the ground plane toward the top element—and spaced from the top element.

In a current embodiment, the top element is supported above the ground plane by shorting elements. Each shorting element is positioned radially outward of the feed. Optionally, the shorting pins are disposed on opposite sides of the feed. The feed element extends through an aperture in the ground plane for coupling to suitable electronics.

The current embodiment further includes a second tubular element electrically coupled to the top element and spaced from the ground plane. The first and second tubular elements are axially offset from each other in a nested relationship, with the first tubular element radially encompassing the second tubular element. The first and second shorting pins extend from the top plate element toward the ground plane in the annulus between the first and second tubular elements.

The antenna optionally includes a patch element supported by the top element, and is adapted for GPS and/or satellite radio communications. The antenna may include an electrically conductive adhesive to mechanically and electrically couple the patch element to the top element.

The antenna of the present invention is compact and provides ultra wide bandwidth for a variety of signals. The antenna is relatively inexpensive and provides significantly enhanced performance over known monopole and inverted-F antennas. The antenna can be directly or indirectly coupled to suitable electronics for LTE, GPS and satellite radio for use in automobiles and other applications.

These and other features and advantages of the invention will be more fully understood and appreciated in view the following description of the following description, drawings, claims and abstract.

DESCRIPTION OF THE CURRENT EMBODIMENTS

An antenna constructed in accordance with a current embodiment of the invention is disclosed in this specification and the drawings. The antenna is a low-profile antenna having increased bandwidth over existing antennas. The antenna includes a modified PIFA having a first cylindrical conductor extending downwardly toward a ground plane and a second cylindrical conductor extending upwardly toward a top plate element. The modified PIFA is particularly well suited for LTE, GPS and satellite radio, demonstrating an improved bandwidth while maintaining a low vertical profile.

Figure 1:
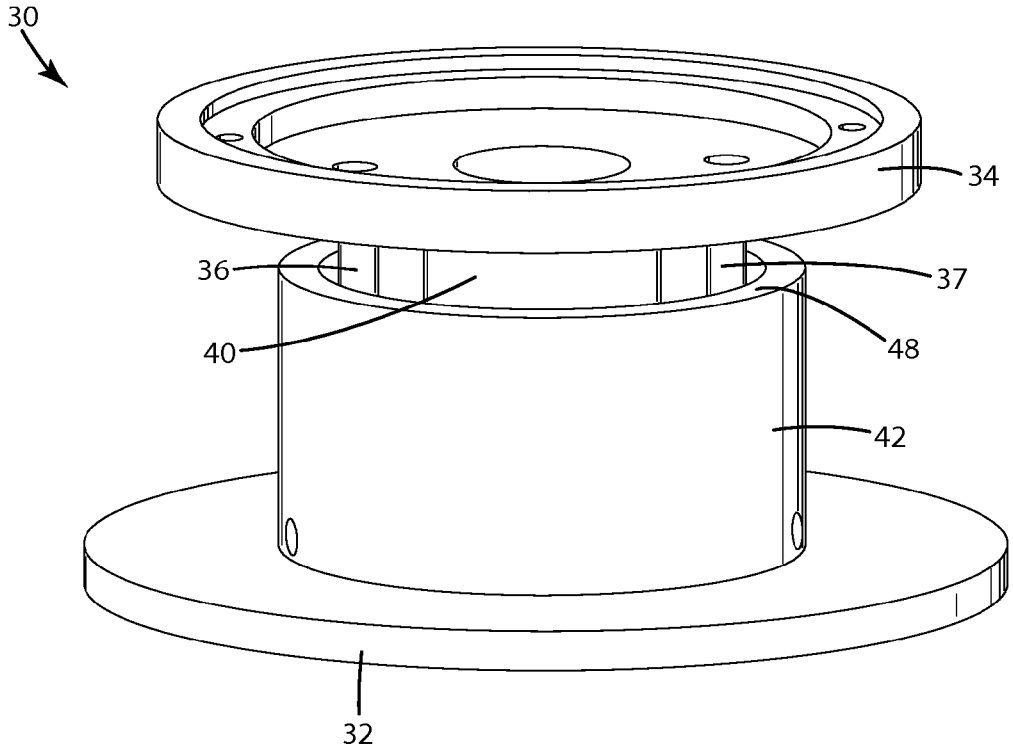
FIG. 1 is a perspective view of an antenna in accordance with the first embodiment of the present invention.
Figure 2:
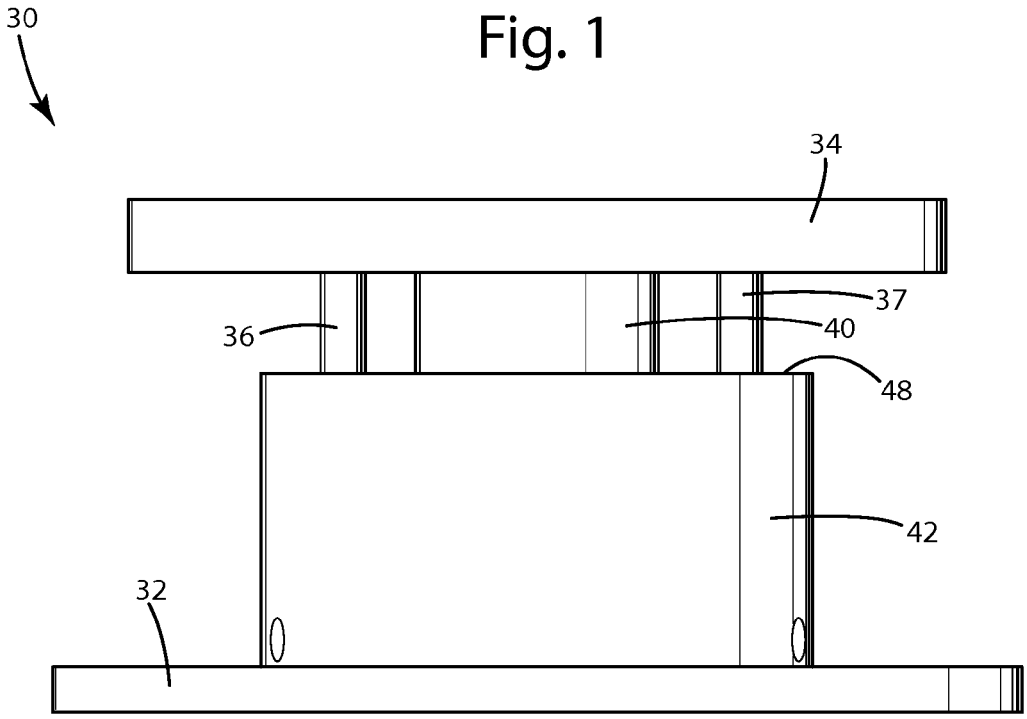
FIG. 2 is a side elevational view of the antenna of FIG. 1.

With reference to FIGS. 1-2, an antenna constructed in accordance with a first embodiment of the invention is illustrated and generally designated 30. The antenna 30 includes a ground plane 32, a top plate element 34, at least one shorting plate or pin 36, 37, a feed wire 38, and first and second cylindrical elements 40, 42. The ground plane 32 and top plate element 34 are spaced apart, being generally parallel and offset by a first distance or height h. The height h of the top plate element 34 above the ground plane 32 is generally fixed at approximately 31.1 mm in the illustrated embodiment, while in other embodiments h varies above or below 31.1 mm. The top plate element 34 introduces capacitance to the input impedance of the antenna 30, which is compensated by first and second shorting pins 36, 37 extending between the top plate element 34 and the ground plane 32. The shorting pins 36, 37 extend downwardly from the top plate element 34 to brace the top plate element 34 and to bridge the top plate element 34 to ground. The feed wire 38 extends downwardly from the first cylindrical element 40 through an opening 44 in the ground plane 32 and is electrically coupled to a suitable transceiver.

The first cylindrical metal element 40 extends downwardly from the top plate element 34, terminating in a lower periphery 46 that is spaced apart from the ground plane 32. The second cylindrical metal element 42 extends upwardly from the ground plane 32, terminating an upper periphery 48 that is spaced apart from the top plate element 34. The first and second cylindrical metal elements 40, 42 are coaxial, with the second cylindrical metal element 42 encompassing lower portions of the first cylindrical metal element 40, the feed wire 38 and the shorting pins 36, 37. That is, the first and second cylindrical metal elements 40, 42 are axially offset from each other and define an annulus 41 in the region therebetween, the annulus being uniform about the outer circumference of the first cylindrical element 40.

Figure 3:
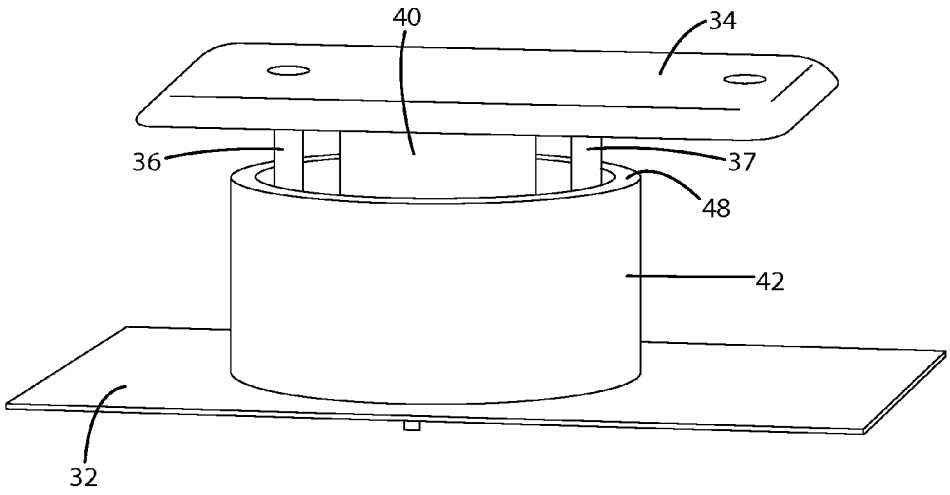
FIG. 3 is a perspective view of the antenna of FIG. 1 modified to include a rectangular ground plane and top plate element.
Figure 4:
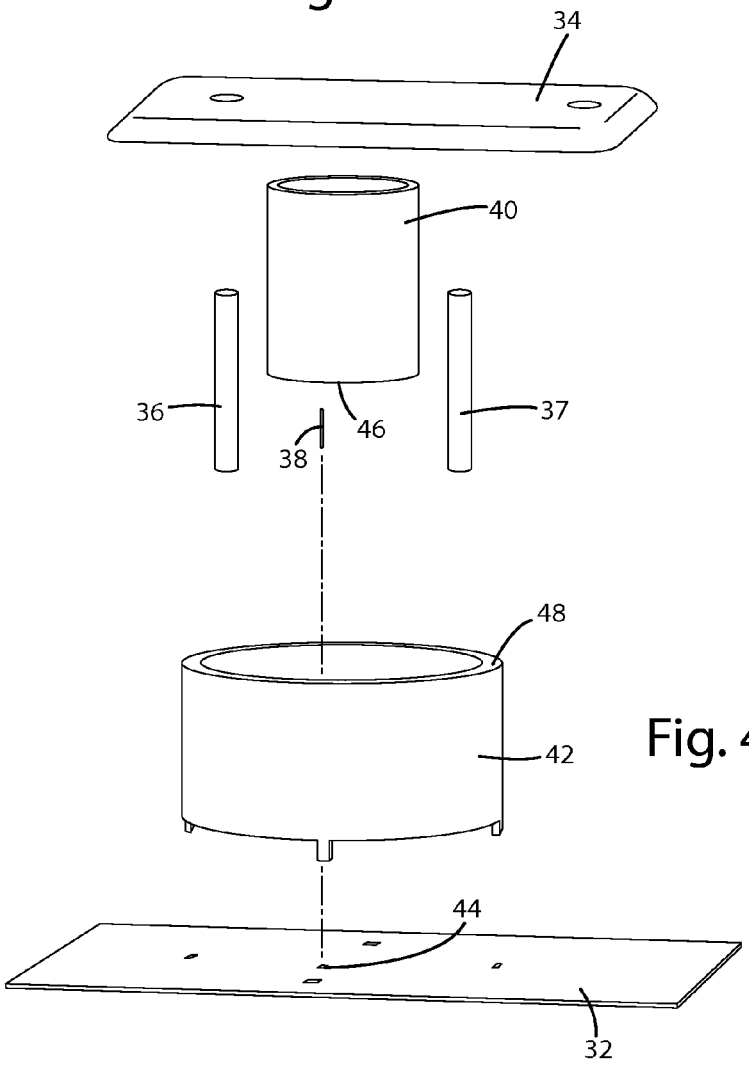
FIG. 4 is an exploded view of the antenna of FIG. 3

The ground plane 32 and top plate element 34 are substantially circular in FIGS. 1-2, but can include other curved or polygonal geometries. For example, the ground plane 32 and the top plate 34 of FIG. 3-4 are substantially rectangular, with the ground plane 32 being at least as extensive as the top plate element 34 in the x and y directions. When the top plate element 34 receives an electromagnetic wave, a signal is transferred through the feed wire 38 to a transceiver. In corresponding fashion, the transceiver can transmit an electromagnetic wave through the feed wire 38 to the top plate element 34. If the transceiver is not co-located with the antenna 30, an optional coaxial cable can interconnect the transceiver and the antenna 30. The coaxial cable can include a core conductor electrically coupled to the feed wire 38, and a metallic shielding layer electrically coupled to the ground plane 32. In some embodiments the antenna 30 is concealed within an aerodynamic fairing atop a vehicle, while in other embodiments the antenna can be concealed within the vehicle structure.

Figure 5:
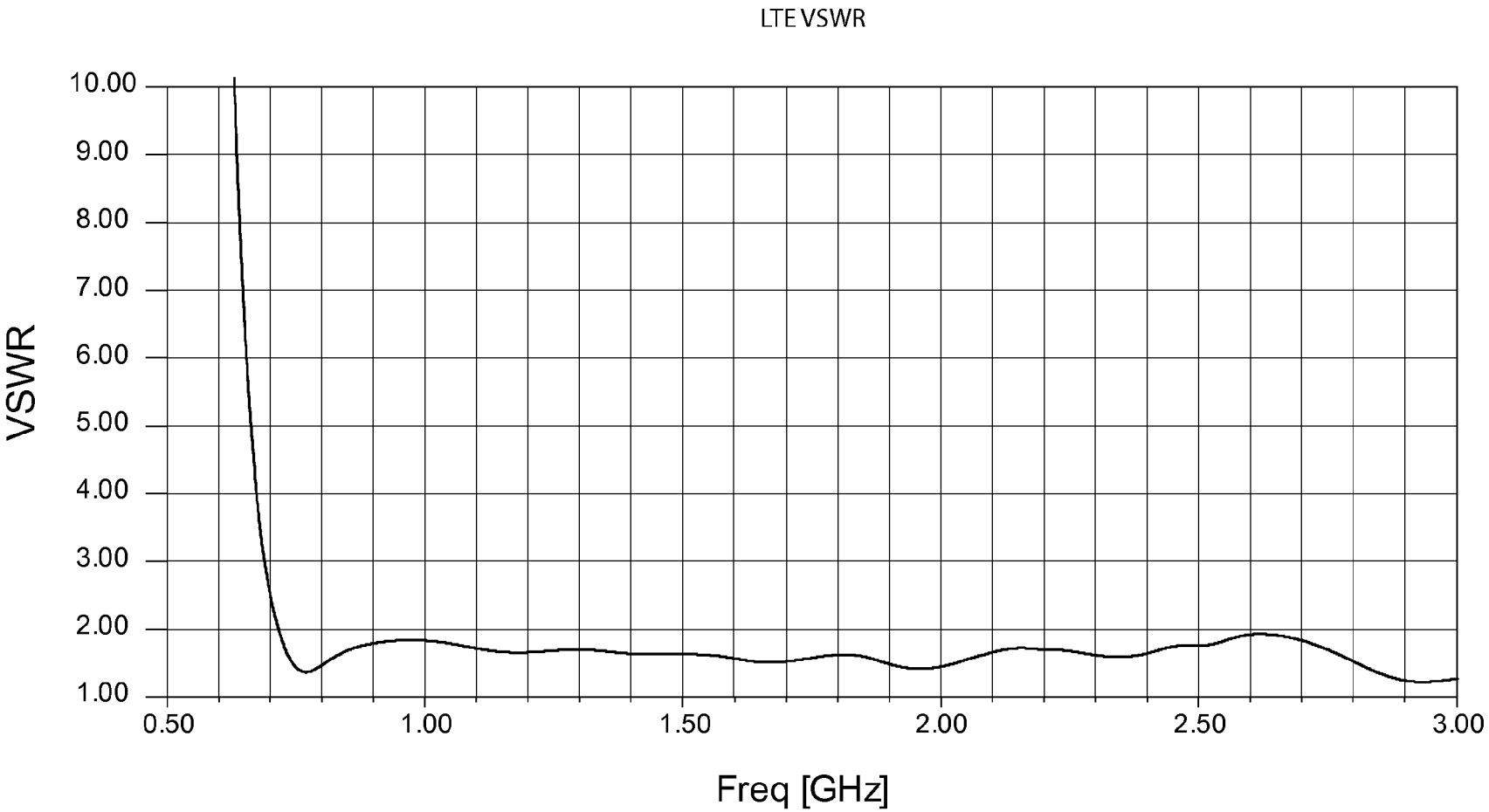
FIG. 5 is a voltage standing wave ratio plot of the antenna of FIGS. 1-2.
Figure 6:
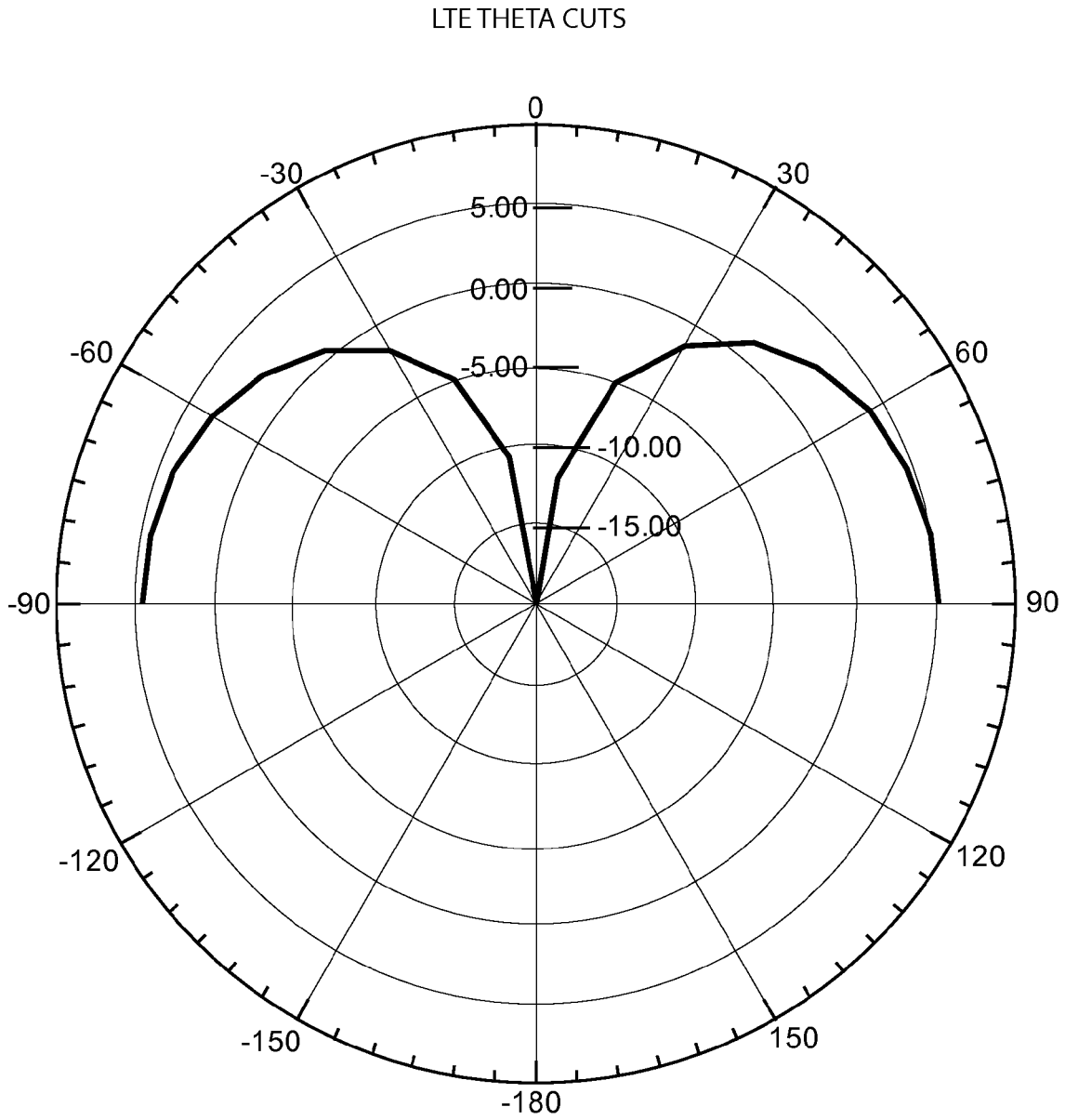
FIG. 6 is a radiation pattern plot for the antenna of FIGS. 1-2 at 0.7 GHz.
Figure 7:
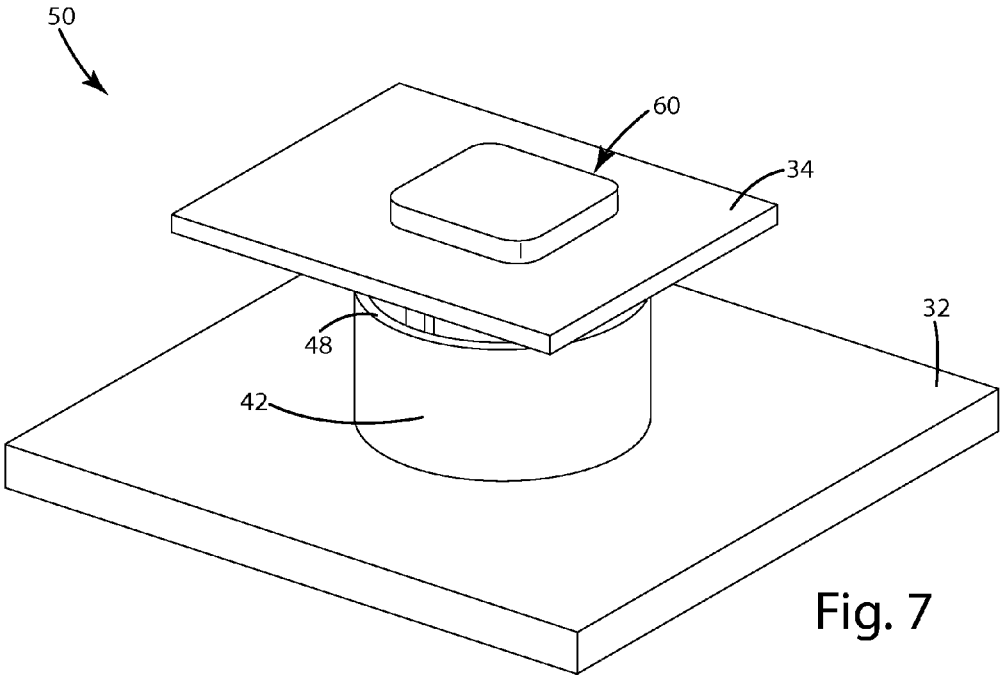
FIG. 7 is a perspective view of an antenna including a satellite radio patch in accordance with a second embodiment of the present invention.
Figure 8:
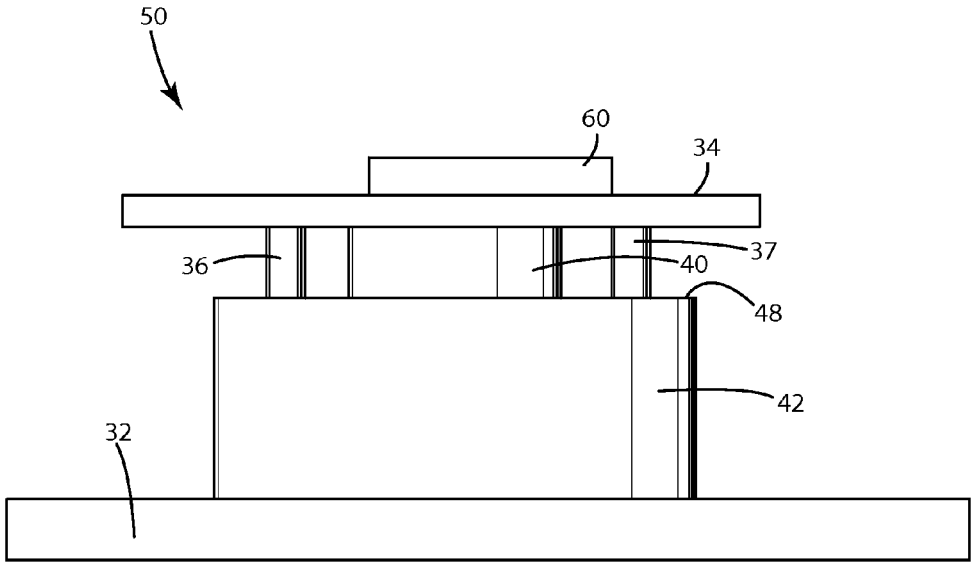
FIG. 8 is a side elevational view of the antenna of FIG. 7.
Figure 9:
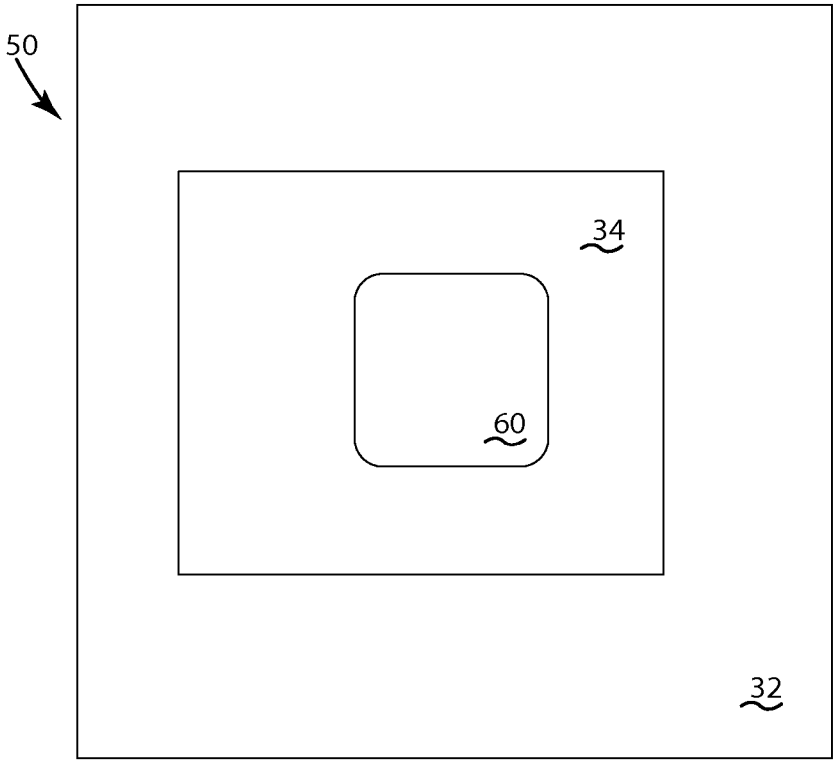
FIG. 9 is a top elevational view of the antenna of FIG. 7.
Figure 10:
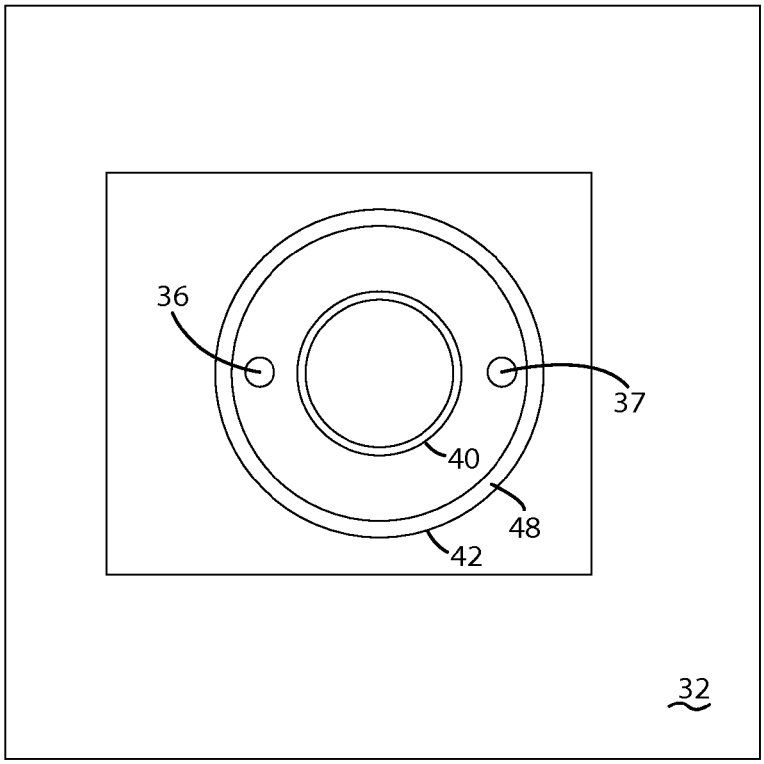
FIG. 10 is a top elevational view of the antenna of FIG. 7 illustrating the ground plane, cylindrical elements and shorting pins.
Figure 11:
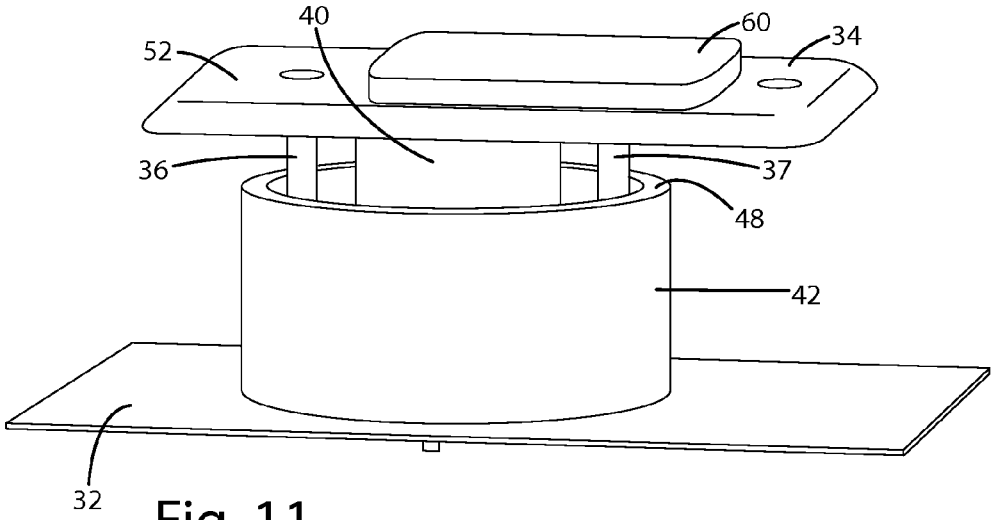
FIG. 11 is a perspective view of the antenna of FIG. 7 modified to include a patch that is laterally offset relative to the top plate element.

The antenna 30 demonstrated improved performance over conventional PIFAs. As shown in FIG. 5, for example, the antenna 30 demonstrated a less than 2:1 Voltage Standing Wave Ratio (VSWR) from ~0.7 GHz to 3.0 GHz, for a bandwidth of 2.3 GHz. By contrast, many conventional PIFAs provide a 2:1 VSWR bandwidth of only 80 MHz. Stated somewhat differently, the VSWR bandwidth for the antenna 30 is over 100%, while the VSWR bandwidth for conventional PIFAs is typically only 10%. In addition, FIG. 6 shows the simulated antenna gain (dB) over an infinite ground plane for the antenna 30. The peak antenna gain for the antenna 30 on an x-y plane is 5.0 dB for 0.7 GHz as shown in FIG. 6, indicating satisfactory antenna performance at the upper and lower frequencies of the 2:1 VSWR bandwidth.

The antenna can optionally include one or more antenna modules or patches. As shown in FIGS. 7-14, for example, an antenna constructed in accordance with a second embodiment of the present invention is illustrated and generally designated 50. The antenna 50 is similar in structure and function to the antenna 30 described above in connection with FIGS. 1-4, and includes a patch 60 supported by the upper surface 52 of the top plate element 34. The patch 60 adds or enhances operability for satellite radio signals, including for example Satellite Digital Audio Radio Services (SDARS) signals such as XM® or Sirius®. In other embodiments, the patch 60 functions as a GPS antenna, a WiFi antenna or other antenna.

Figure 12:
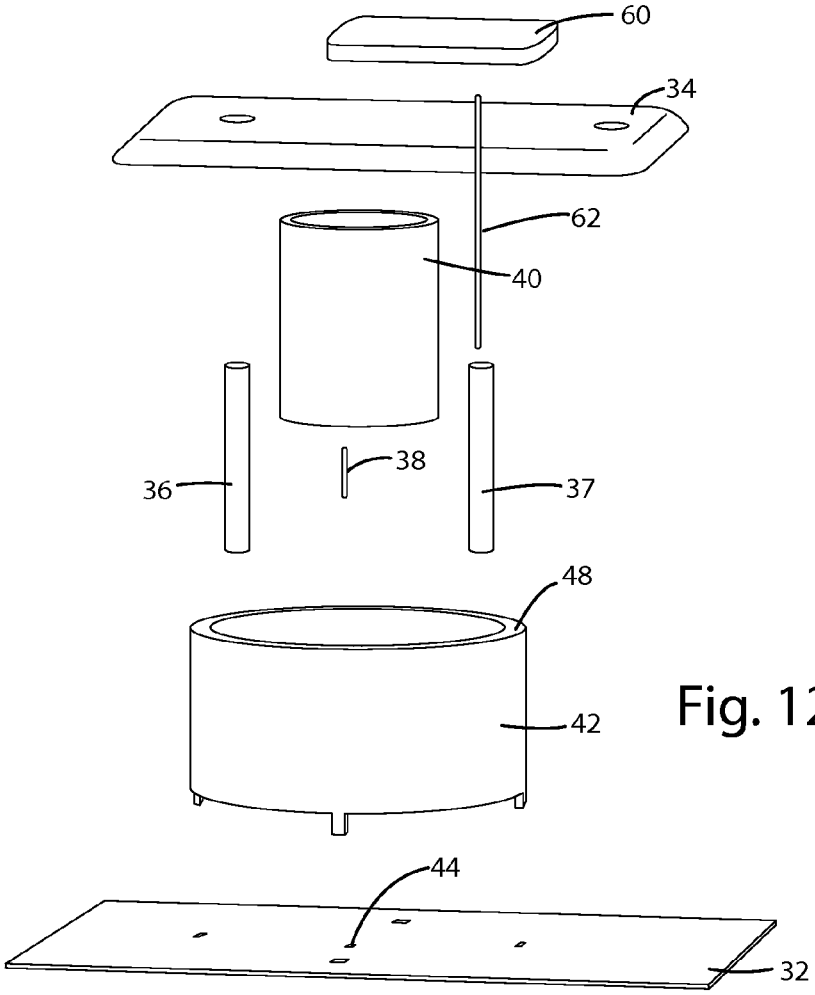
FIG. 12 is an exploded view of the antenna of FIG. 11.
Figure 13:
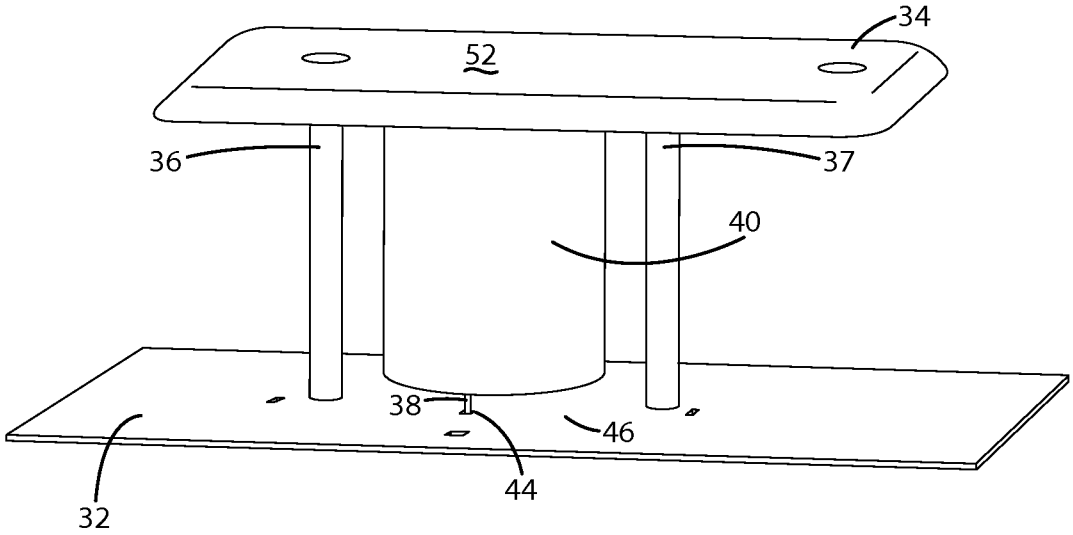
FIG. 13 is a perspective view of the antenna of FIG. 11 illustrating the shorting pins and first cylindrical element.

The patch 60 is mechanically coupled to the top plate element 34 and secured thereto by a double-sided adhesive. In some embodiments the antenna 50 includes a dielectric layer interposed between the top plate element 34 and the patch 60, while in other embodiments the patch 60 is bonded to the upper surface of the top plate element 52 using an electrically-conductive adhesive. As best shown in FIG. 12, a probe pin 62 is electrically coupled to the patch 60 and extends downwardly therefrom. The probe pin 62 extends through an aperture in the top plate element 34 and into the interior of the second shorting pin 37, being spaced apart from the same. That is, the probe pin 62 includes an outer diameter less than the inner diameter of the shorting pin 37. The probe pin 62 continues through an opening in the ground plane 32 until it is electrically coupled (directly or indirectly) to the transceiver. The top plate element 34 optionally defines a length of 65 mm, a width of 53 mm, and a height (or thickness) of 3.25 mm. The top plate element 34 is spaced apart from the ground plane 32 by a distance h of 30 mm in the present embodiment. The first cylindrical element 40 defines a height of 26 mm. The second cylindrical metal structure 42 defines a height of 21 mm, an inner diameter of 32 mm and an outer diameter of 42 mm. In this configuration, the upper periphery 48 of the second cylindrical structure 42 is spaced apart from the top plate element 34 by approximately 5.75 mm. In addition, the lower periphery 46 of the first cylindrical structure is paced apart from the ground plane 32 by approximately 0.75 mm. Each shorting pin 36, 37 includes a 3.25 mm outer diameter in the present embodiment, being approximately equal to the thickness of the top plate element 34.

Figure 14:
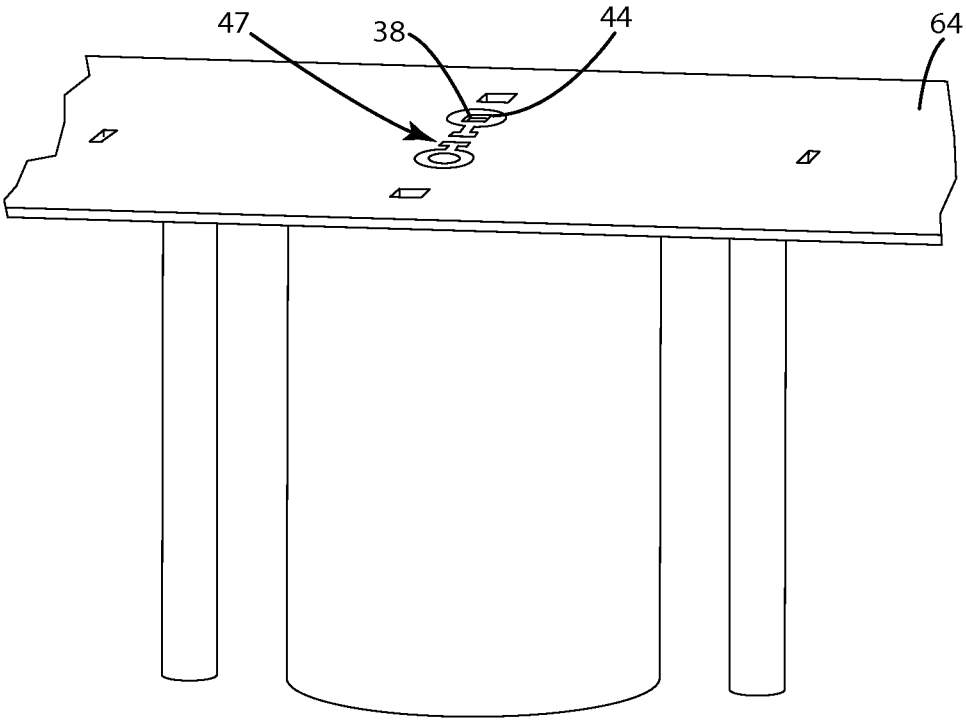
FIG. 14 is a perspective view of the underside of the ground plane of FIG. 11 illustrating a capacitor.

Referring again to FIGS. 7-10, the antenna 50 and patch 60 are substantially coaxial. In addition, the top plate element 34 and patch 60 define a common angular orientation, such that the top plate element 34 and the patch 60 are not rotated with respect to each other. In other embodiments, however, the patch 60 is laterally and/or angularly offset relative to the antenna 50. For example, the patch 60 in FIGS. 11-14 is laterally offset from center and is instead positioned over a shorting pin 37. In addition, the ground plane 32 optionally includes a printed circuit board (PCB). As shown in FIG. 14, the ground plane 32 in this embodiment can include a capacitor 47 disposed on a lower surface 64 thereof and having a capacitance of between 2.5 pF to 6.0 pF.

Figure 15:
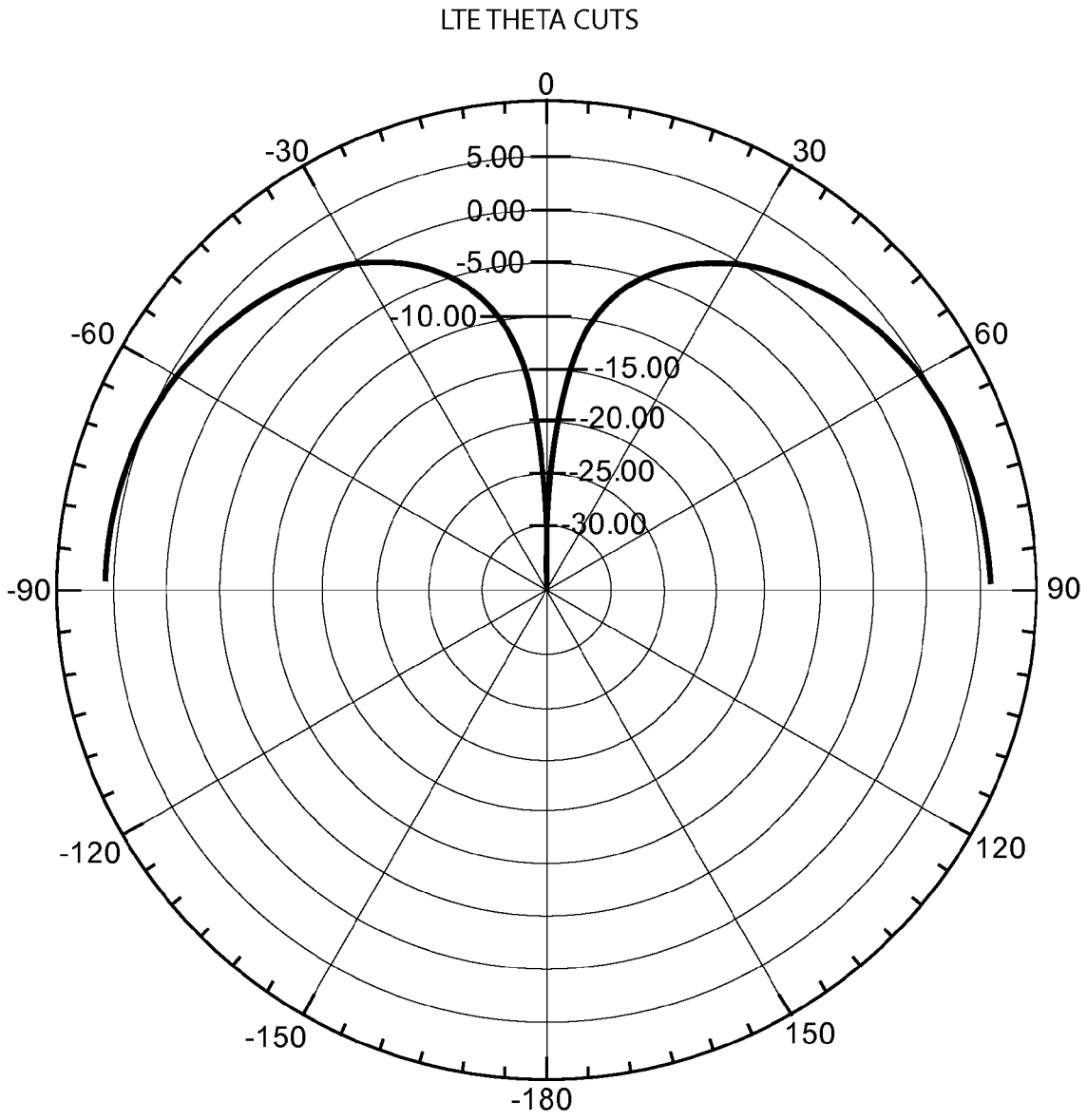
FIG. 15 is a radiation pattern plot for the antenna of FIG. 7 at 0.7 GHz at phi=90°.
Figure 16:
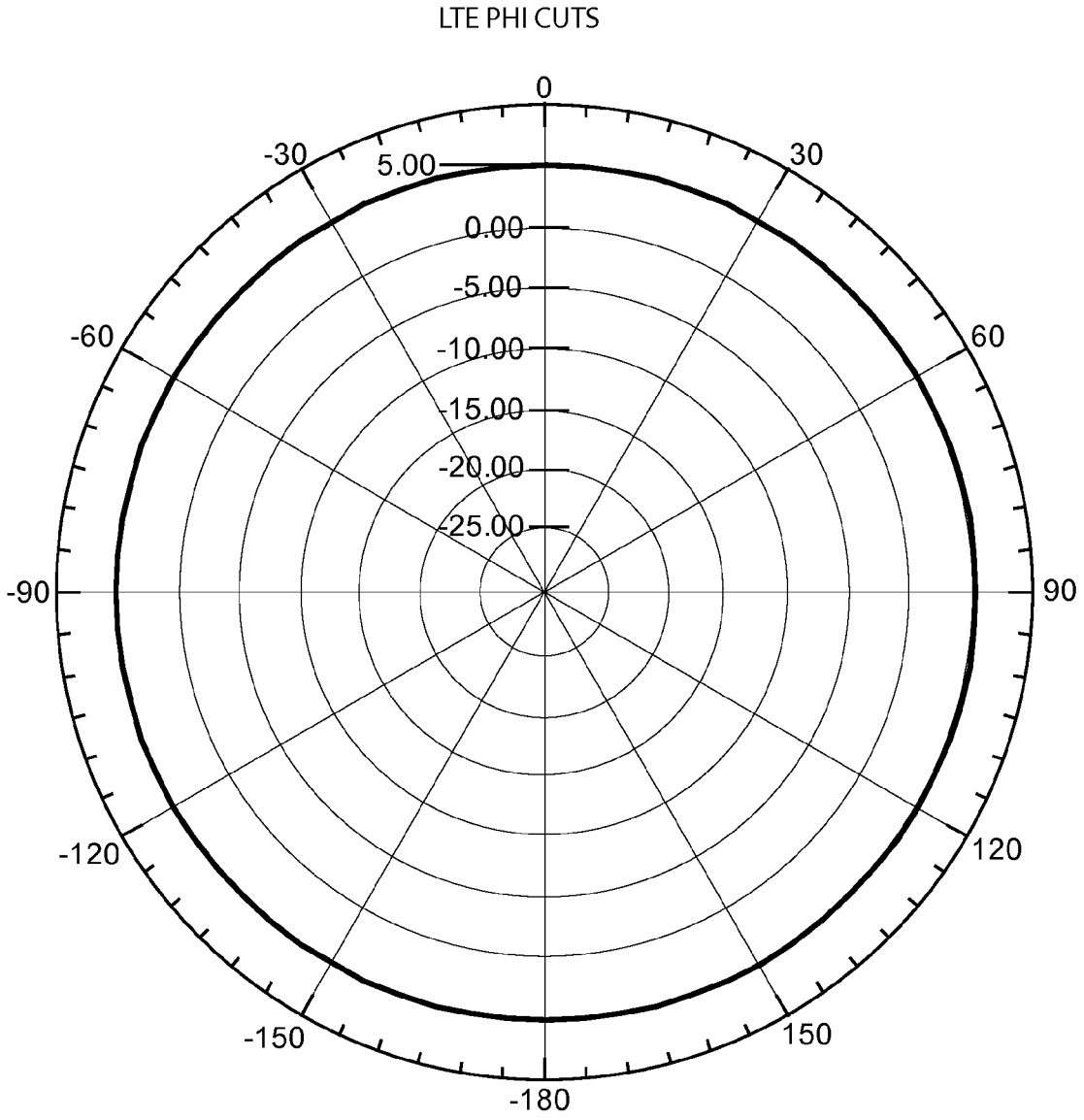
FIG. 16 is a radiation pattern plot for the antenna of FIG. 7 at 0.7 GHz at theta=90°.
Figure 17:
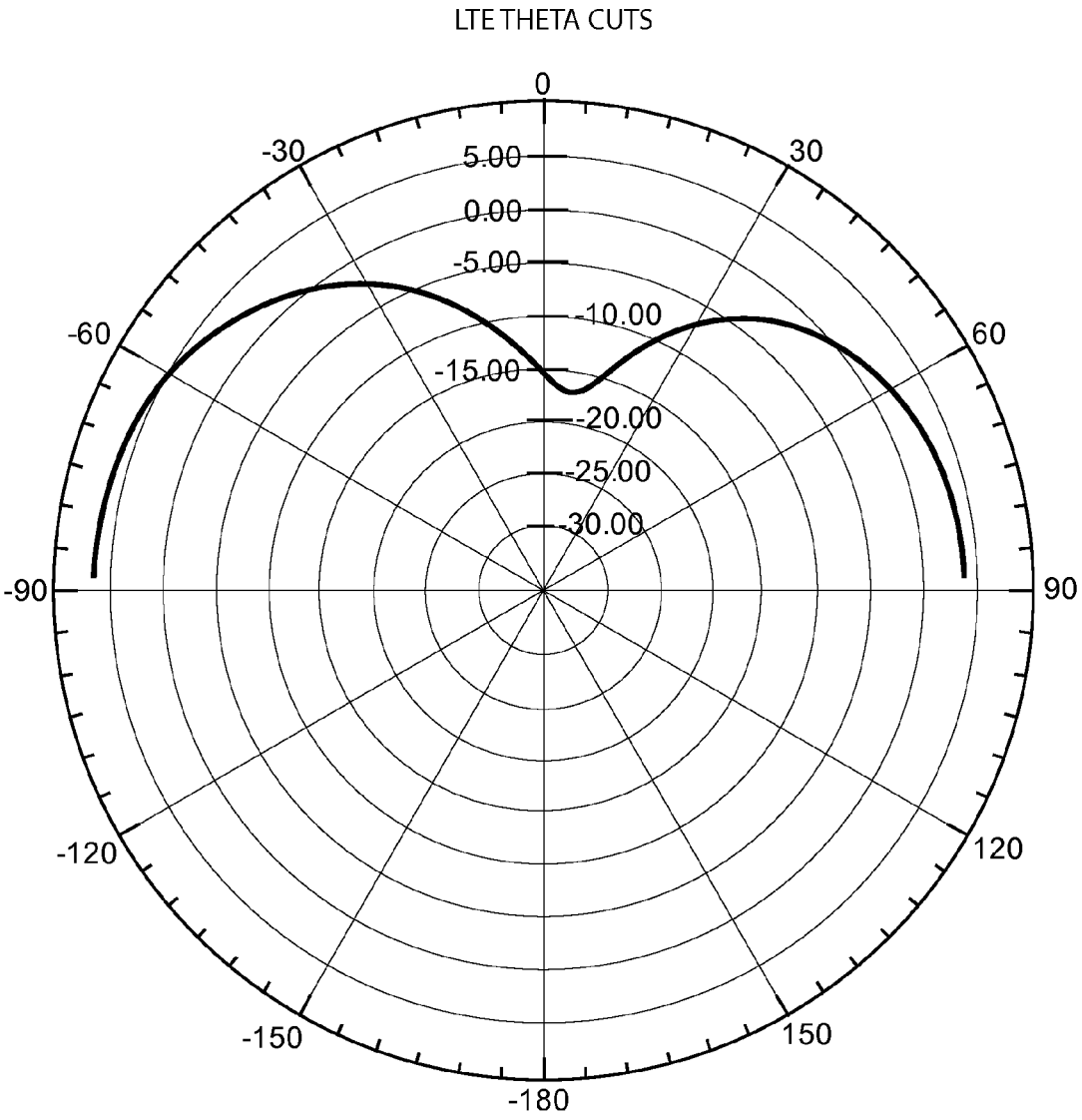
FIG. 17 is a radiation pattern plot for the antenna of FIG. 7 at 2.5 GHz at phi=90°.
Figure 18:
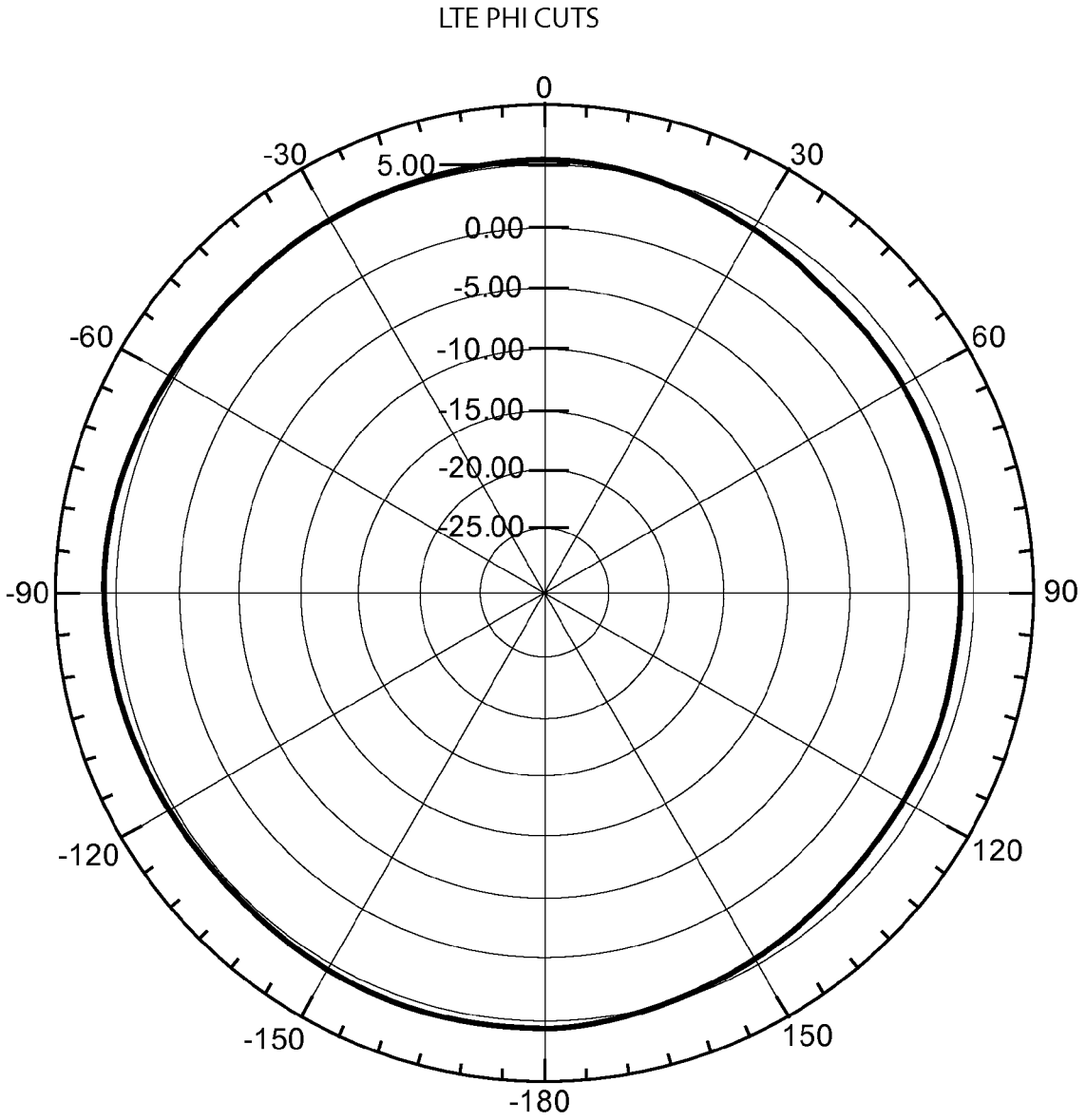
FIG. 18 is a radiation pattern plot for the antenna of FIG. 7 at 2.5 GHz at theta=90°.
Figure 19:
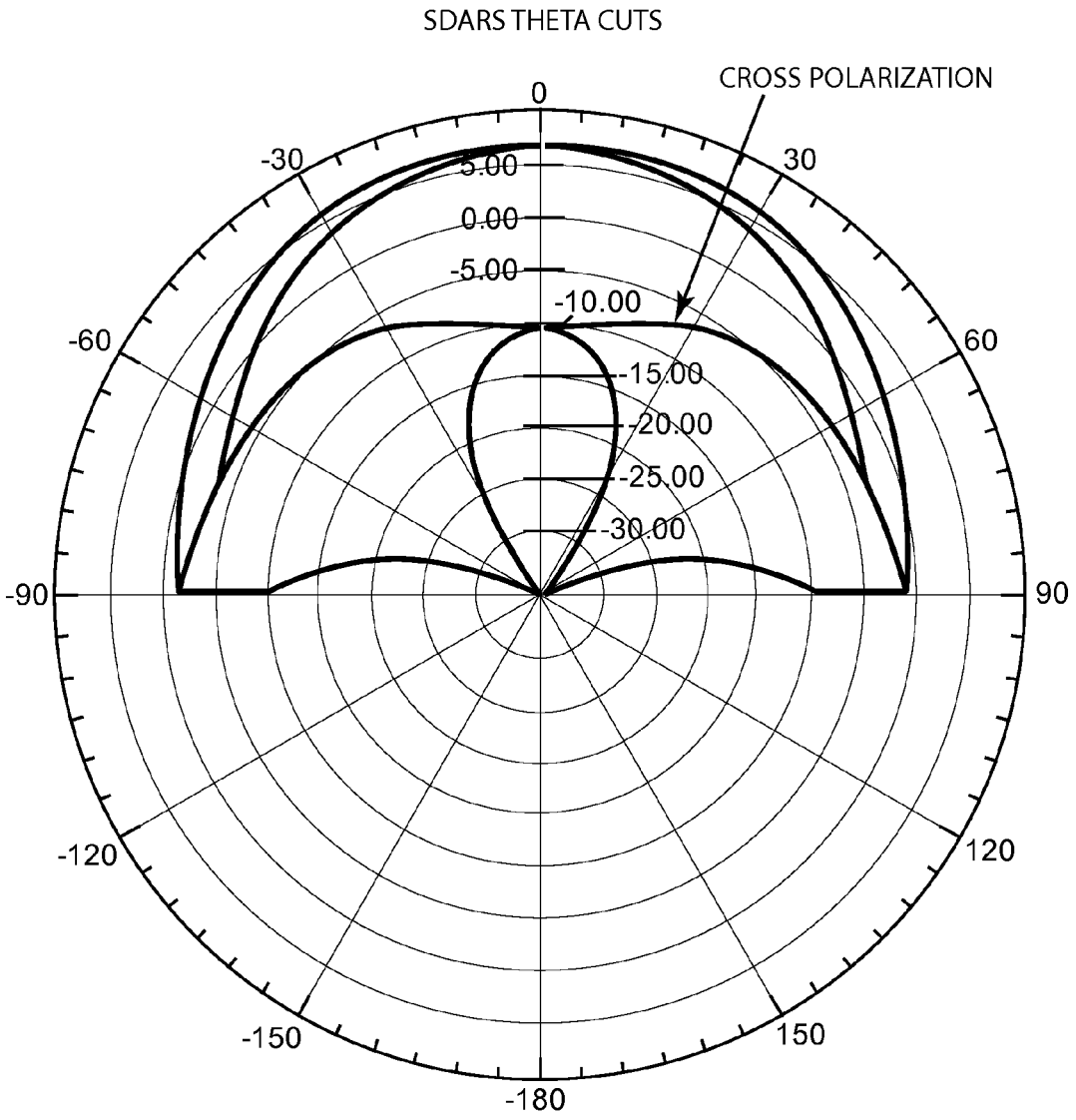
FIG. 19 is a radiation pattern and cross-polarization plot for the satellite radio patch of FIG. 7 at 2.34 GHz at phi=90°.
Figure 20:
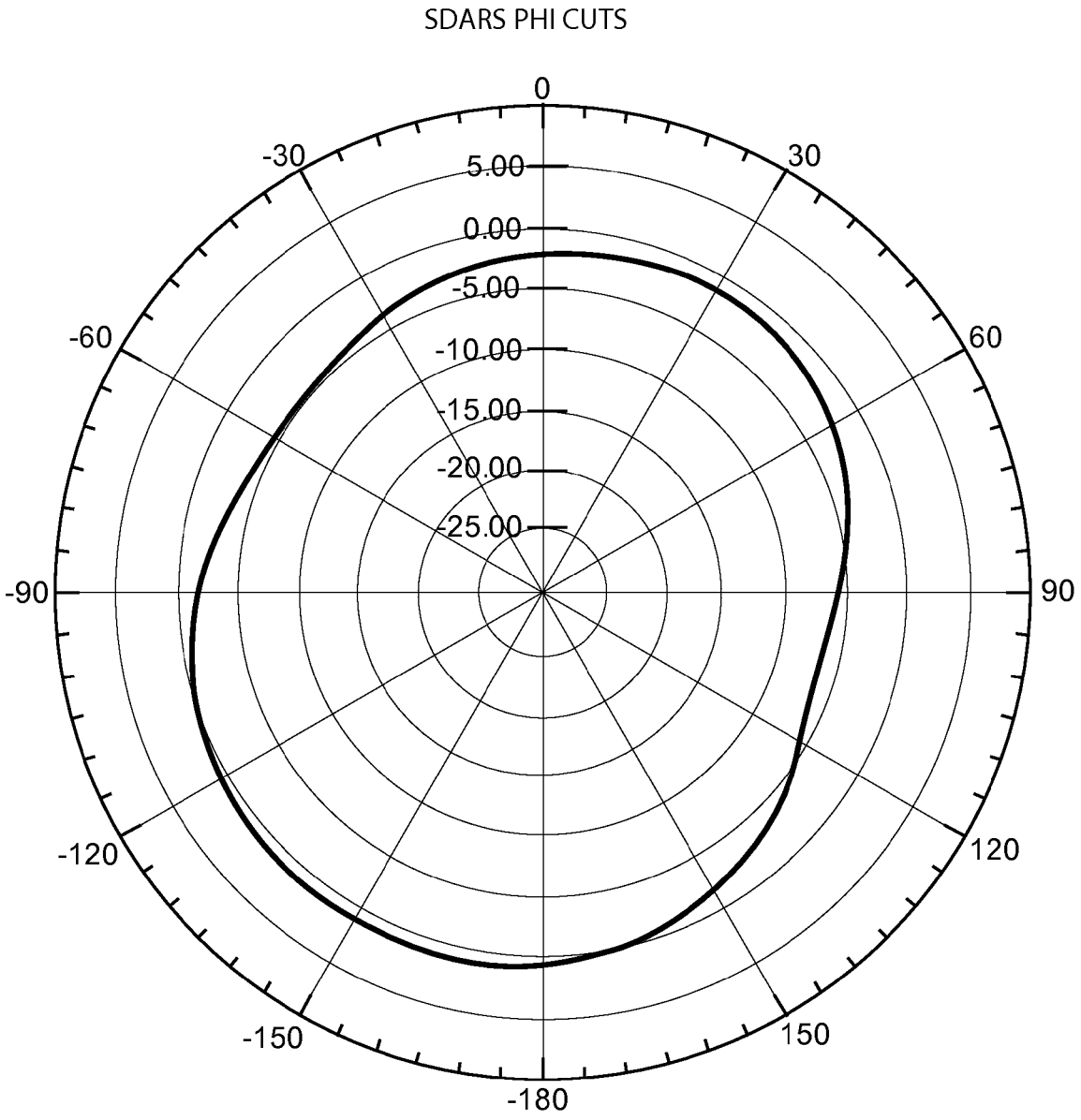
FIG. 20 is a radiation pattern plot for the antenna of FIG. 8 at 2.34 GHz at theta=90°.
Figure 21:
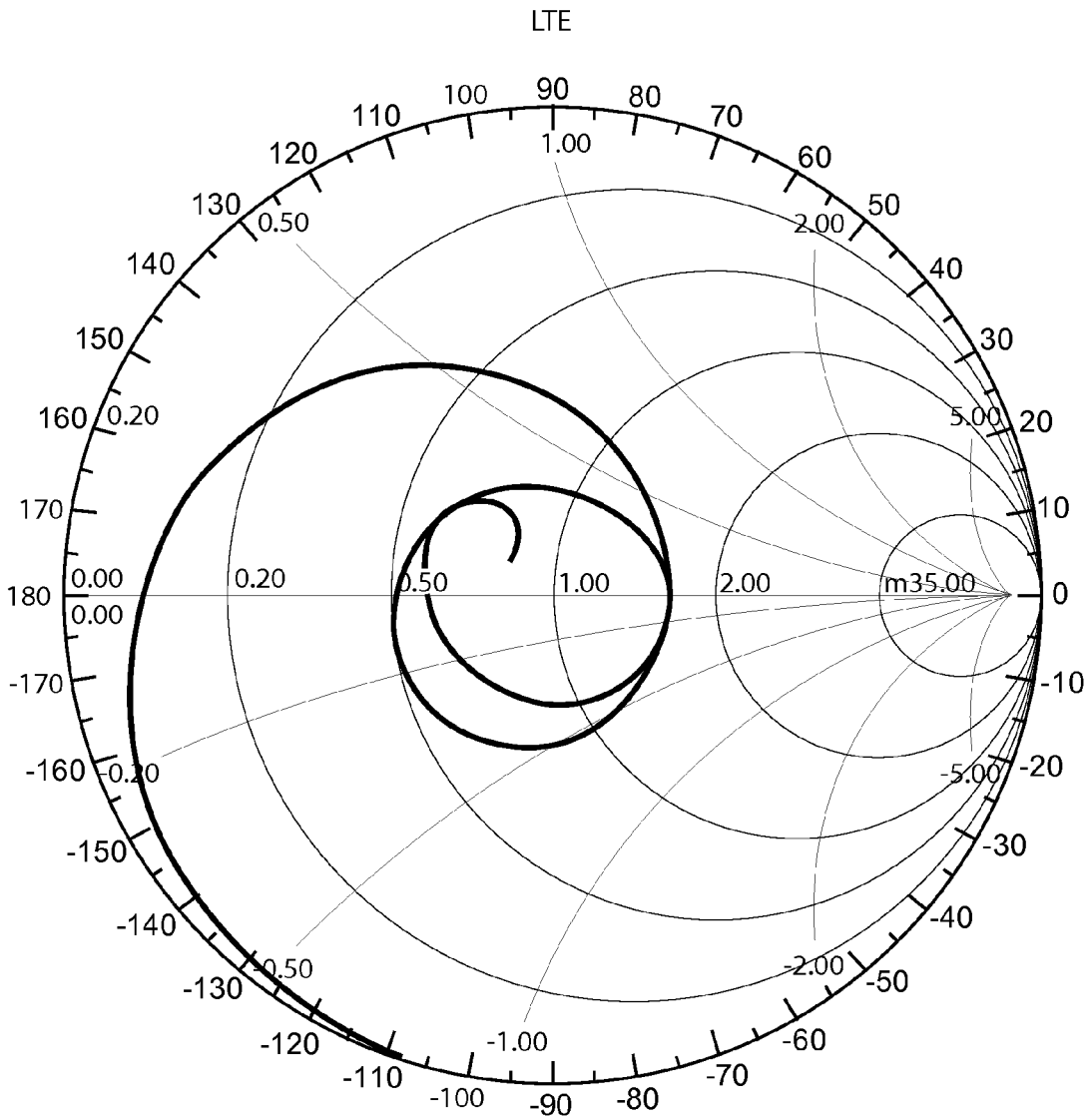
FIG. 21 is a Smith chart depicting the simulated impedance variation of the antenna of FIG. 7.
Figure 22:
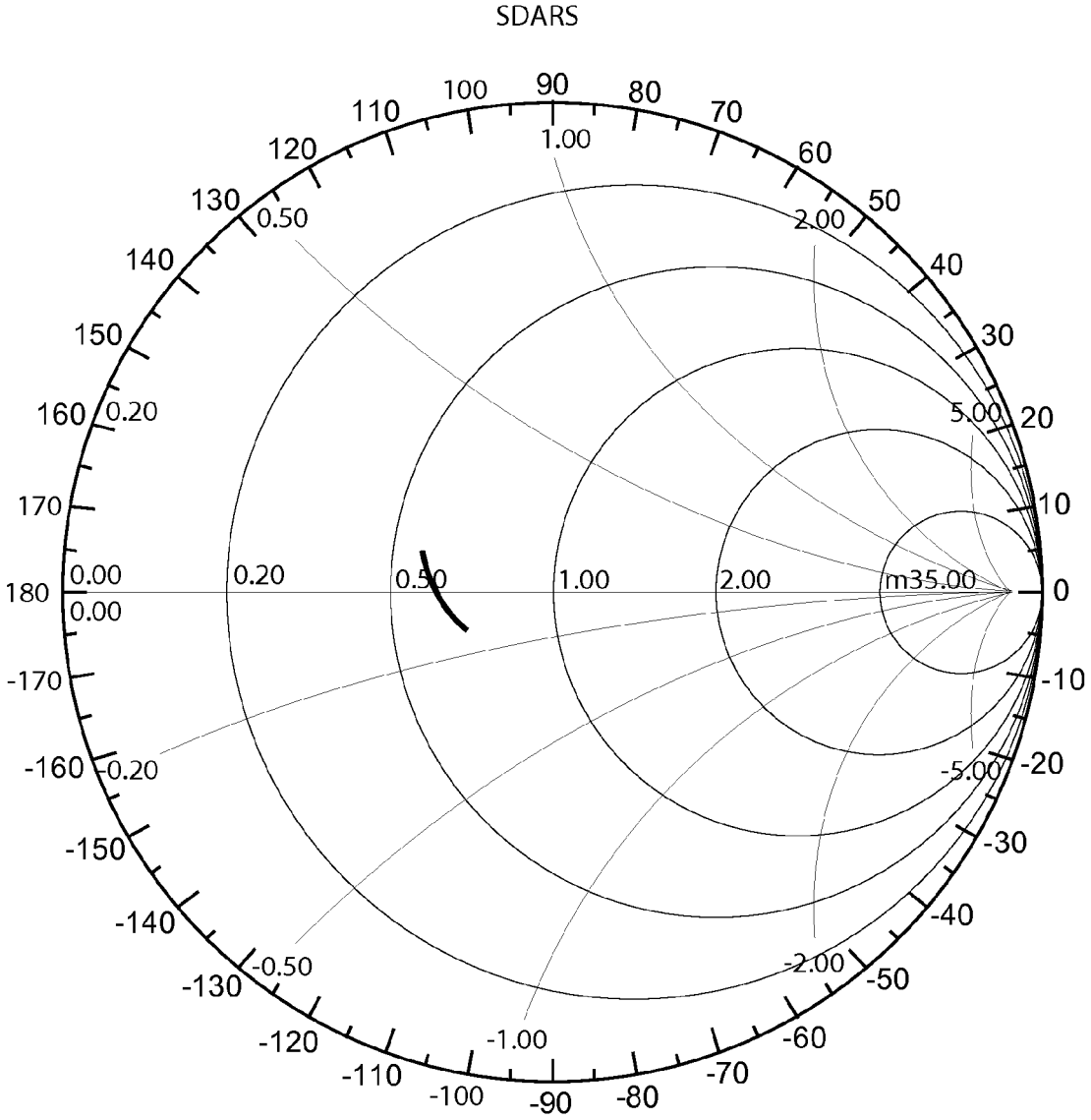
FIG. 22 is a Smith chart depicting the simulated impedance variation of the satellite radio patch of FIG. 7.
Figure 23:
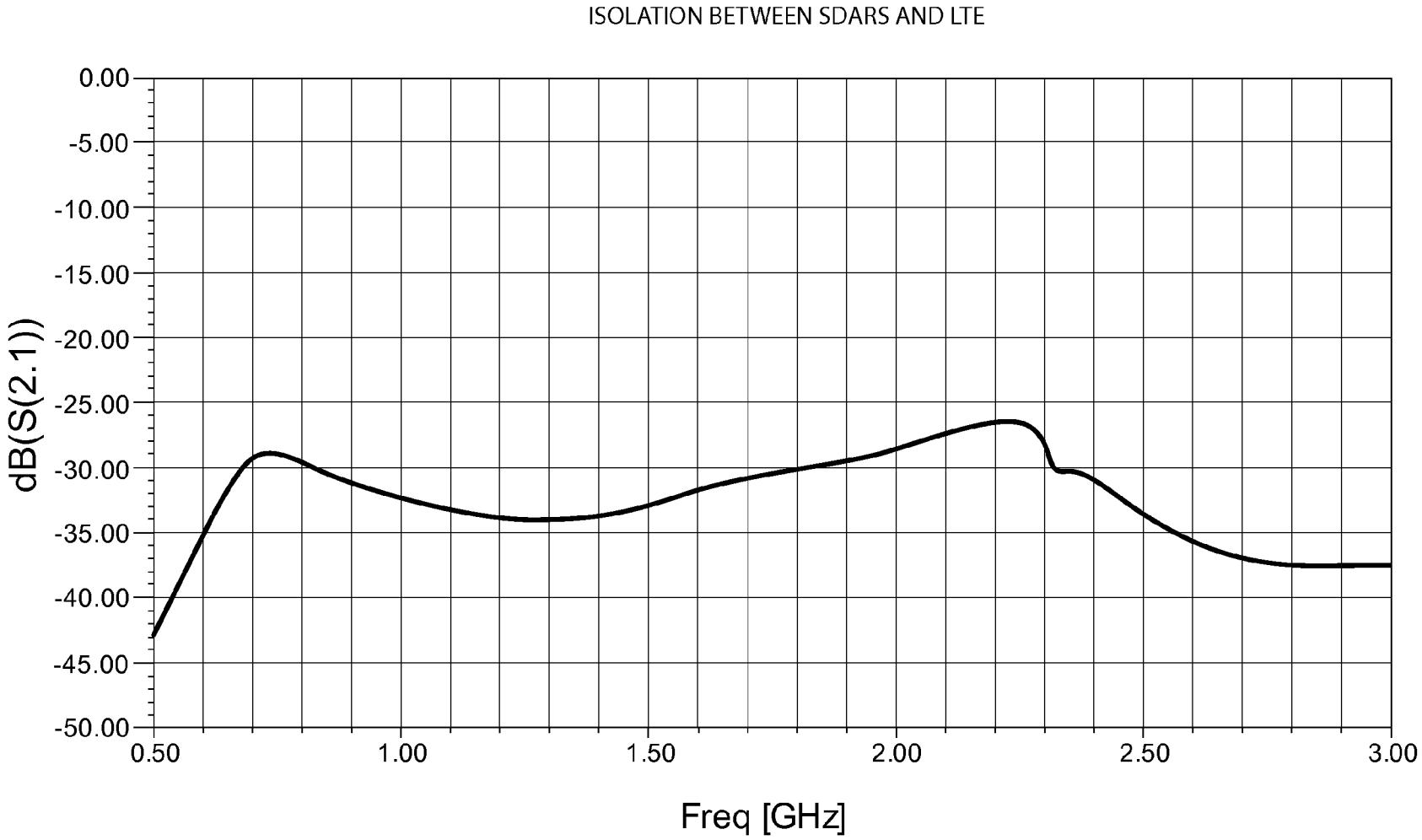
FIG. 23 is an isolation plot between the LTE antenna and satellite radio patch of FIG. 7.

Simulated results for VSWR bandwidth, antenna gain and impedance were obtained for the antenna 50 and the patch 60 and confirmed in laboratory testing. As shown in FIG. 5, the antenna 50 demonstrated a less than 2:1 VSWR fractional bandwidth from ~0.7 GHz to 3.0 GHz. The peak antenna gain at 0.7 GHz is 5.0 dB as shown in both FIG. 15 (phi=90°) and in FIG. 16 (theta=90°). The peak antenna gain at 2.5 GHz is 5.0 dB as shown in both FIG. 17 (phi=90°) and in FIG. 18 (theta=90°). The peak antenna gain for the patch 60 at 2.34 GHz is 7.0 dB and cross-polarization (RHCP) is −10 dB at zenith as shown in FIG. 19 (phi=90°) and 2.0 dB in FIG. 20 (theta=90°). FIGS. 21 and 22 are Smith plots illustrating the simulated impedance variation for the antenna 50 and patch 60, respectively. FIG. 23 is an isolation plot depicting operation of the antenna 50 and patch 60 over a frequency range from 0.5 GHz to 3.0 GHz. FIG. 23 illustrates that an LTE signal is predominantly coupled to the antenna 50 and not the patch 60, and that an SDARS signal is predominantly coupled to the patch 60 and not the antenna 50.

In the current embodiments, the antenna and patch are formed of a suitable electrically conductive material, including for example nickel, silver or stainless steel. The bottom plane 32, top plate element 34 and patch 60 are substantially planer, having a thickness generally between 0.5 mm and 5 mm. These elements are of the same or similar thicknesses in the current embodiments, and are substantially parallel to each other. Alternatively, the bottom plane 32, top plate element 34 and/or patch 60 could vary in thickness and be angled relative to one another, and can optionally include one or more slots or cutouts. In addition, the shorting pins 36, 37 feed wire 38, first and second cylindrical elements 40, 42 and probe pin 62 are generally perpendicular to the bottom plane 32, top plate element 34 and patch 60. However, the relative sizes, shapes and orientation of these antenna elements and/or patch(es) can be tuned or modified to achieve the desired performance for a particular application.

The above descriptions are those of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. An antenna comprising:

a ground plane;

a generally planar top antenna element spaced from the ground plane;

a shorting element electrically connected between the ground plane and the top antenna element; and an electrically conductive tubular element electrically connected to the ground plane, the axis of the tubular element generally perpendicular to the ground plane, the tubular element extending from the ground plane toward the top antenna element, the tubular element spaced from the top element.

2. The antenna of claim 1 wherein the tubular element surrounds at least a portion of the shorting element.

3. The antenna of claim 1 further including a second electrically conductive tubular element electrically connected to the top antenna element, the axis of the second tubular element generally perpendicular to the top antenna element, the second tubular element extending from the top antenna element toward the ground plane, the second tubular element spaced from the ground plane.

4. The antenna of claim 1 further including two of the shorting elements.

5. The antenna of claim 4 wherein the shorting elements are spaced radially outward of the feed element.

6. The antenna of claim 5 wherein the first tubular element surrounds the shorting elements.

7. An antenna comprising:

a first assembly including a planar antenna element and a first electrically conductive tubular element electrically connected to the antenna element, the axis of the first tubular element generally perpendicular to the antenna element;

a feed electrically connected to the first assembly; and a second assembly including a ground plane and a second electrically conductive tubular element electrically connected to the ground plane, the axis of the second tubular element generally perpendicular to the ground plane, the first tubular element and the second tubular element physically interfitting with one another without contacting one another, the first tubular element not contacting the ground plane, the second tubular element not contacting the antenna element.

8. The antenna of claim 7 further comprising first and second shorting elements electrically connected between the antenna element and the ground plane.

9. The antenna of claim 8 wherein the first and second shorting elements are disposed radially outward of the first tubular element and radially inward of the second tubular element.

10. The antenna of claim 7 further comprising at least one patch element overlying and supported by the antenna element.

11. The antenna of claim 10 wherein the antenna element defines an upper surface opposite the ground plane, the at least one patch element overlying and coupled to the antenna element upper surface.

12. The antenna of claim 10 wherein the patch element is at least one of an SDARS antenna element and a GPS antenna element.

13. An antenna system comprising:

a planar inverted-f antenna (PIFA) including a ground plane, a top planar element spaced apart from the ground plane, a shorting element electrically connected between the top element and the ground plane;

a first electrically conductive tubular element electrically connected to the top element, the first tubular element generally perpendicular to the top element, the first tubular element extending from the top element toward the ground plane but not contacting the ground plane; and a second electrically conductive tubular element electrically connected to the ground plane, the second tubular element generally perpendicular to the ground plane, the second tubular element extending from the ground plane toward the top element but not contacting the top element, the first and second tubular elements partially interfitting with one another without contacting one another; and a patch antenna and supported by the top element.

14. The antenna system of claim 13 wherein the PIFA and the first tubular element comprise an LTE antenna, and the patch antenna is an SDARS antenna.

15. The antenna system of claim 13 wherein the first and second tubular elements are coaxial.

16. The antenna system of claim 13 wherein the first and second tubular elements are axially offset from each other.

17. The antenna system of claim 13 wherein the first tubular element defines a lower axial periphery spaced apart from the ground plane.

18. The antenna system of claim 13 wherein the second tubular element defines an upper axial periphery spaced apart from the top element.

* * * * *

UNITED STATES PATENT AND TRADEMARK OFFICE

CERTIFICATE OF CORRECTION

PATENT NO. : 8,681,052 B2
APPLICATION NO. : 13/252566
DATED : March 25, 2014
INVENTOR(S) : Andreas D. Fuchs It is certified that error appears in the above-identified patent and that said Letters Patent is hereby corrected as shown below:

In the Claims

Col. 6, Claim 13, Line 67: the terms "antenna and supported" should be "antenna overlying and supported"

Signed and Sealed this
Eighth Day of July, 2014

Michelle K. Lee

Michelle K. Lee
*Deputy Director of the United States Patent and Trademark Office*